US005524690A

United States Patent [19]

Bortoloso et al.

[11] Patent Number: 5,524,690

[45] Date of Patent: Jun. 11, 1996

[54] SUPPORT DEVICE FOR A CURTAIN MOVABLE IN TWO MUTUALLY ORTHOGONAL DIRECTIONS

[76] Inventors: Mario Bortoloso, Via dei Nani, 6, 36015 Schio VI; Raimondo Carollo, Via Dante, 79, 36016 Thiene VI, both of Italy

[21] Appl. No.: 955,744

[22] PCT Filed: Jun. 12, 1991

[86] PCT No.: PCT/EP91/01091

§ 371 Date: Dec. 6, 1993

§ 102(c) Date: Dec. 6, 1993

[87] PCT Pub. No.: WO91/19447

PCT Pub. Date: Dec. 26, 1991

[30] Foreign Application Priority Data

Jun. 19, 1990 [IT] Italy ..... 21380/90 U

[51] Int. Cl.[6] ..... E06B 9/00

[52] U.S. Cl. ..... 160/128; 160/84.01

[58] Field of Search ..... 160/128, 330, 160/84.01, 84.02, 84.03, 84.04, 84.05, 84.06, 84.07, 84.08, 84.09, 84.11

[56] References Cited

U.S. PATENT DOCUMENTS 1,460,597 7/1923 Maurer ..... 160/84.1 R
1,482,978 2/1924 Edwards .
1,772,661 8/1930 Fredericks .
4,909,297 3/1990 Koller et al. ..... 160/84.1 R X

FOREIGN PATENT DOCUMENTS 8910970 9/1989 Germany .
48022 11/1990 Italy .
1436957 5/1976 United Kingdom ..... 160/84.1 R

*Primary Examiner* Blair M. Johnson
*Attorney, Agent, or Firm* Conley, Rose & Tayon

[57] ABSTRACT

A support device (1) for a curtain (2), in particular for room with at least a floor (P) and a wall (4) in relation to which the curtain (2) is hung, comprising at least one guide element (5) along which slides at least one mechanism (10) for raising the curtain (2) and designed to guide the movement of a corresponding cord (11) or the like connects to a free end of the said curtain, said movement permitting said end to be raised from the floor parallel to the said wall. The said device (1) comprises means of control (40, 50) that determine the movement of the cord or the like with respect to the raising mechanism (10) and the sliding movement of the latter along the guide element (5). Said movements of the cord and raising mechanism occur in two mutually orthogonal directions.

35 Claims, 2 Drawing Sheets

SUPPORT DEVICE FOR A CURTAIN MOVABLE IN TWO MUTUALLY ORTHOGONAL DIRECTIONS

BACKGROUND

This invention relates to a support device for a curtain, in particular for a room with at least a floor and a wall in relation to which the curtain is hung.

There are two types of curtains already known to the art and commercially available, which we will refer to as "traditional" curtains and "box" curtains: the first are curtains that move between appropriate guides of their various support devices in a direction essentially parallel to the floor, and the second are curtains that move in a plane perpendicular to the floor.

Use of such prior art curtains often depends on the taste of the decorator or user of the room in which they are hung. Sometimes, however, the choice depends on specific functional requirements.

In this regard, consider walls with windows that run the entire height of the walls. With windows of this kind, box curtains cannot be used, because their usual support device, with associated raising mechanisms that guide the movement of curtains of this kind, cannot be mounted near to the windows without impeding or at least hampering their opening.

Therefore, even if the user wishes to use box curtains, deeming them more consonant with the decorating style of the room or perhaps merely more in harmony with his sense of aesthetics, he is obliged to select and use traditional curtains, for which the support device can be produced with dimensions that do not interfere with the opening of the curtain.

SUMMARY

These and other objects that will be obvious to one skilled in the art are accomplished by a curtain support device, in particular for a room with a floor and at least one wall in relation to which the curtain is hung, characterized in that it comprises at least one guide element along which can slide at least one curtain raising mechanism designed to guide the movement of a corresponding cord, tape or the like connected to one end of the said curtain opposite the end near the said guide element, said movement of the cord resulting in the raising of the curtain or a portion thereof with respect to the floor, there being control means to allow for the movement of the cord through the corresponding raising mechanism and the sliding of the latter along the guide element, said sliding resulting in the displacement of the curtain or at least a portion thereof on a plane essentially parallel to the above-mentioned floor.

The object of this invention, therefore, is to describe a curtain support device that allows a curtain to move in the manner typical of conventional "box" curtains and in the manner typical of "traditional" curtains, either separately or in combination.

Another object is to describe a device of the aforesaid kind that is simple, easy to make and mount and modest in cost.

BRIEF DESCRIPTION OF THE DRAWINGS

For a better understanding of the invention, the following drawings are given strictly by way of example and not of limitation, in which.

DESCRIPTION OF THE PREFERRED EMBODIMENTS

Figure 1:
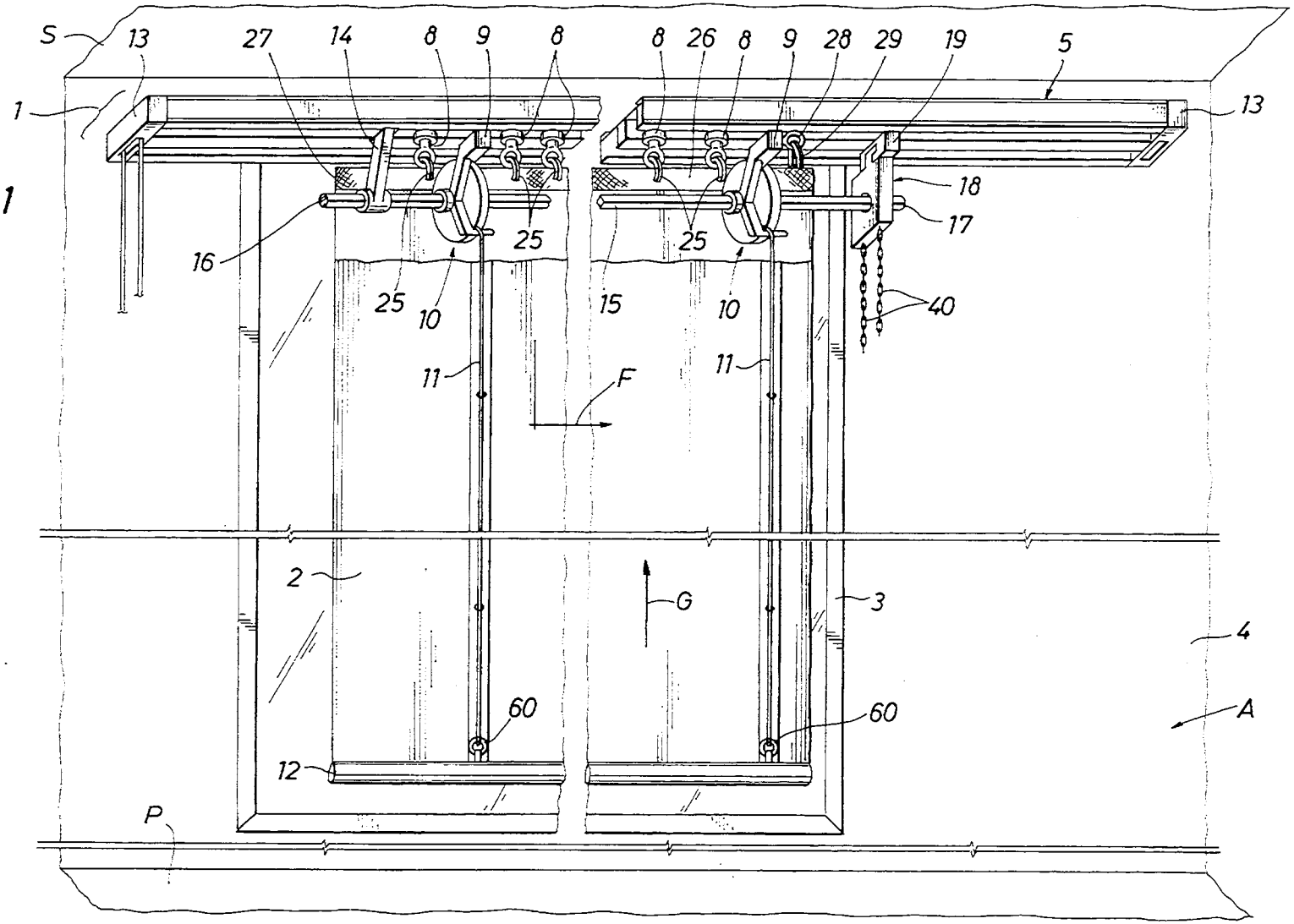
FIG. 1 is a partial perspective view of the device pursuant to the invention mounted in the proximity of a window.
Figure 2:
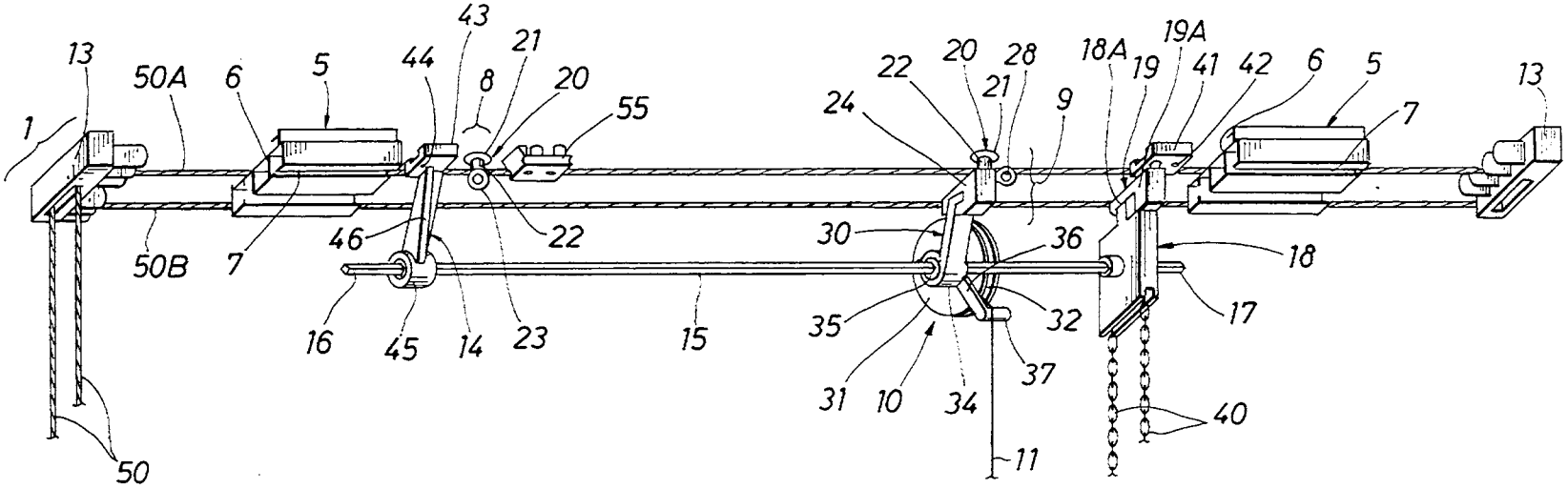
FIG. 2 is a schematic, split perspective view of the device in FIG. 1, showing the characteristic elements thereof.

With reference to FIGS. 1 and 2, the device 1 pursuant to the invention supports a curtain 2 hung by a window 3 located in a wall 4 of a room A, said room having a floor P and a ceiling S.

The device 1, attached in a conventional manner to the wall P or the ceiling S of the room A comprises (in the example shown in FIGS. 1 and 2) a channel or channel-like element 5 defined by a section 6 in which at least one guide track 7 has been created; in the latter are movably positioned a plurality of rings or sliding elements 8 and bearings 9 for raising mechanisms 10 for the movement of corresponding ropes or cords 11 connected to one end 12 0f the curtain 2. Said mechanisms, by moving the cords raise the curtain 2 from the floor P, said raising motion occurring on a plane essentially parallel to the wall 4.

To the channel-like element 5 are also connected two end closings or caps 13 and at least one arm 14 designed to support a shaped shaft with a polygonal cross-section 15. Said arm is positioned near one end 16 of the shaft 15; the other end 17 of it in turn interacts with a conventional chain control mechanism (or the like) 18 affixed to element 5 through a bearing element 19. Each raising mechanism 10 is mounted on the shaft 15.

More specifically, each ring or sliding element 8 and each bearing 9 have one end 20 shaped, in the example shown in the drawings, essentially like a mushroom, the enlarged head 21 of which interacts with the track 7, while a stem 22 connects the aforesaid head with an annular member 23 (for each sliding element 8) or with a block 24 (for each bearing 9).

Each annular member 23 interacts with a hook 25 affixed (by sewing or otherwise) to a first tape 26 permanently attached to one end 27 of the curtain 2 close to the device 1.

To each block 24, on the other hand, is affixed, by a restrained joint, for example, an arm 30 on which is rotatably mounted a roller 31; the latter has a groove 32 in which is wound, in a manner conventional in itself, a corresponding cable 11. The said block bears a ring 28 designed to interact with a hook 29 affixed to the abovementioned tape 26.

Alternatively, said block 24 may be formed in one piece with the arm 30.

The latter has an end 34 shaped like a ring in which the shaft 15 fits. The latter penetrates a hole 35 in the roller 31, said hole having a cross-section complementary to that of the shaft 15 to allow for torsional interaction between the roller and the said shaft 15. Said roller 31 however, may slide along the shaft 15.

From the arm 30 extends a conventional bearing 36, on the end of which is mounted a prior art turnbuckle 37 for the cable 11.

The arm 30, the roller 31 and the elements connected to them constitute a raising mechanism 10 for a cable or cord 11.

The control mechanism 18 is a conventional control mechanism with chain 40 for the movement of "box" curtains and will therefore not be described in greater detail.

Said mechanism 18 is connected to the bearing element 19 in some prior art manner (for example, by restrained oint between corresponding parts 19A and 18A). Element 19 has one end 41 shaped essentially like a "C" and affixed by a screw 42 to element 5.

An analogous end 43 is found on the arm 14 supporting the shaft 15, said end being affixed to element 5 by means of a screw 44. The arm 14 also has another end 45 in the shape of a ring, in which the shaft 15 is positioned. The arm 14 also has mounted on it a stiffening rib 46.

Inside the channel-like element 5 is positioned a cord 50. Said cord has two parallel sections 50A and 50B emerging from a closing 13 in such a way that they are free to move; in the other closing 13 the cord 50 is folded back in a "U" (possibly by passing over redirecting pulleys present in said element), thereby creating the aforesaid sections.

On said cord 50, finally, is mounted a draw slide 55 that slides within the track 7. Said slide allows for movement of the curtain 2 parallel to the wall 4.

For that purpose, pulling on one of the sections of the cord 50 (depending on whether the curtain 2 is spread across the window 3 or drawn aside with respect to it) causes the slide 55 to move within the track 7. By interacting with the rings 8, it causes them to move (slide) within the channel-like element 5.

As a result of that sliding motion, the curtain 2 is drawn parallel to the wall 4 along the floor P (arrow F in FIG. 1); it should be noted that when the slide 55 is moving, not only do the rings 8 slide in the track 7, but the bearings 9 also slide. This means that each roller 31 also slides on the (fixed) shaft 15.

Now, pulling on the chain 40 causes the shaft 15 to rotate (in a manner conventional in itself). That rotation is transferred to the roller 31, which in moving winds up on itself the cable 11, thereby raising the curtain 2 (arrow G in FIG. 1) with respect to the floor P.

It should be noted that in order to maintain tension on the curtain 2, weights 60 are provided at least at the points of attachment of the cables 11 to the end 12 of the curtain; alternatively, a metal chain can be positioned along that entire end.

Figure 3:
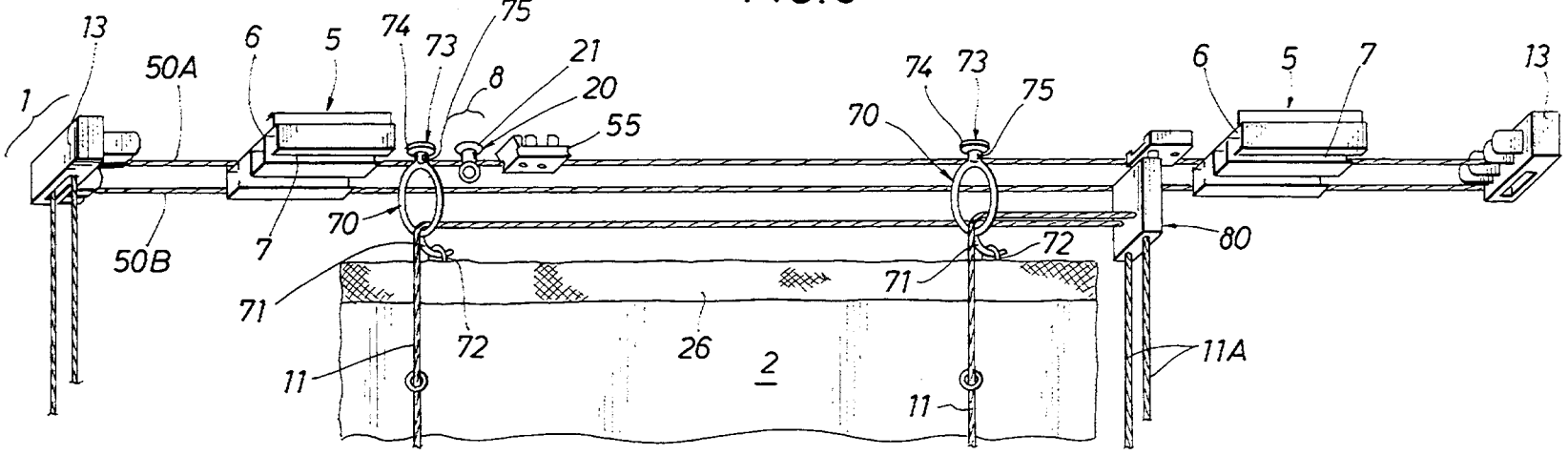
FIG. 3 shows another, different embodiment of the invention in perspective view similar to that of FIG. 2.

FIG. 3 shows another possible embodiment of the invention. In this drawing, parts that correspond to those in FIGS. 1 and 2 are labelled with the same reference numbers.

In the drawing in question, the raising mechanisms 10 consist of simple static redirecting elements 70 in the form of rings.

The redirecting elements or rings 70 (conventional in themselves) have a hook-like element 71 designed to interact with a corresponding annular element 72 affixed to the curtain 2, thereby linking the curtain with the corresponding ring 70.

The latter in turn is designed to slide within the guide element 5.

For that purpose, each ring 70 has (in the example in FIG. 3) a mushroom-shaped end 73 with a head 74 designed to slide in the track 7 and a stem 75 connected to the annular portion of the ring.

Operation of the device as shown in FIG. 3 is analogous to that in FIGS. 1 and 2.

In fact, pulling on the extensions 11A of the cords 11 (passing through a redirecting mechanism 80 attached to element 5 like the abovementioned mechanism 18 in FIGS. 1 and 2) makes the latter slide in the redirecting elements 70 and raises the curtain like a "box curtain."

Pulling on cord 50, on the other hand, makes the curtain move like a "traditional curtain."

Examples of possible embodiments of the device pursuant to the invention have been described, in which getting the curtain 2 to move like a "traditional curtain" is achieved by pulling on cord 50.

Obviously, the same movement can be accomplished by pulling directly on the curtain and drawing it along a plane parallel to the floor P; at the same time, the raising mechanisms 10 permanently attached to the curtain are drawn along with it.

In addition, other embodiments of the invention are possible, such as an embodiment that comprises an arrangement of the mechanisms 10 in the form of rollers 31, free to slide along the shaft 15 and not firmly fixed to a channel-like element 5; in such case the guide element becomes the aforesaid shaft 15, and the movement of the rollers may be activated by moving the curtain 2 as previously described.

A device pursuant to the invention makes it possible to perform a "box" or "conventional" motion with the curtain 2, in other words, to perform a raising motion or an at least partial sliding motion with said curtain 2 with respect to the floor P.

Such motion can be performed by means of control mechanisms 40, 50 either separate from each other or united in a single mechanism.

We claim:

1. A support for supporting a curtain on a wall above a floor comprising:

a guide element along which slides at least one raising mechanism for raising the curtain;

said raising mechanism guiding the movement of a corresponding first cord connected to a first end of the curtain opposite to a second end near the guide element, movement of the first cord resulting in the raising of at least a portion of the curtain with respect to the floor; and control means connected to said guide element allowing for the movement of the first cord by means of the corresponding raising mechanism and the sliding of the raising mechanism along the guide element, such sliding resulting in the displacement of at least a portion of the curtain in a direction essentially parallel to the floor.

2. The support according to claim 1, wherein the guide element is a channel-like element comprising a section in which is created at least one slide track for the raising mechanism, the section being closed at the ends by closing elements, the raising mechanism being suitably connected to the curtain.

3. The support according to claim 2, further comprising a second cord positioned inside the channel-like element and having two sections parallel to one another, the second cord undergoing a reversal in one closing element and emerging from the other closing element so that the second cord can be moved.

4. The support according to claim 3, further comprising a plurality of fastening elements connected to the curtain and a first bearing for the raising mechanism of the first cord connected to the curtain, said fastening elements and said first bearing being movably mounted in said track of the channel-like element, and at least one of said elements and said first bearing interacting with a drawing slide connected to the second cord.

5. The support according to claim 4, wherein the fastening elements and the first bearing for the raising mechanism have a first end with an enlarged head capable of sliding in the track of the channel-like element and a stem connected to other parts of said fastening elements and said first bearing.

6. The support according to claim 5, wherein the stem of each fastening element is affixed to an annular element, and further comprising hooks permanently attached to a tape on the curtain, said hooks being capable of interacting with said annular element.

7. The support according to claim 5, wherein the stem of the first bearing for the raising mechanism interacts with a block to which is connected an annular element, and further comprising a hook permanently attached to a tape on the curtain, said hook being capable of interacting with said annular element and said block being connected with a first arm supporting a roller for moving the first cord.

8. The support according to claim 7, wherein the block and the first arm supporting the roller are formed as one piece.

9. The support according to claim 7, further comprising a shaft on which the roller slides, said shaft fitting into a ring at one end of the first arm and being capable of torsionally interacting with the walls of a hole in the roller and being supported by a second bearing element permanently attached to the channel-like element, the shaft being connected with a control mechanism for activating the movement of the curtain, said control mechanism interacting with a chain and being affixed to the channel-like element.

10. The support according to claim 9, wherein the second bearing element for the shaft with which the raising mechanism interacts has a second arm with one end affixed to the channel-like element, on which said second arm there is a stiffening rib, said second bearing element having one end in the shape of a ring designed to hold the shaft.

11. The support according to claim 9, further comprising a third bearing element with one end affixed to the channel-like element, said third bearing element connected to the control mechanism for activating the curtain movement.

12. The support according to claim 11, wherein the third bearing element for the control mechanism for activating the curtain movement is formed in one piece with said control mechanism.

13. An apparatus drawing a curtain in a first and a second direction, comprising:

a guide member;

sliding elements movably positioned on said guide member and attached to a first end of the curtain;

a raising mechanism movably positioned on said guide member;

a first cord connected to a second end of the curtain and coupled to said raising mechanism, said first cord interacting with said raising mechanism for drawing the curtain in the first direction; and a second cord coupled to said sliding elements and said raising mechanism, said second cord interacting with said sliding elements and said raising mechanism for drawing the curtain in the second direction.

14. The apparatus of claim 13, wherein said guide member has a track on which said raising mechanism and said sliding elements slide.

15. The apparatus of claim 13, wherein said sliding elements have a first end with a head slidingly coupled to said guide member and a stem connected to an annular element.

16. The apparatus of claim 15, further comprising hooks coupled to said annular elements and attached to the curtain.

17. The apparatus of claim 13, further comprising a draw slide mounted on said second cord, said draw slide interacting with said sliding elements and said raising mechanism for drawing the curtain in the second direction.

18. The apparatus of claim 13, further comprising a control mechanism affixed to said guide member for controlling the movement of said first cord, said control mechanism causing said first cord to interact with said raising mechanism for drawing the curtain in the first direction.

19. The apparatus of claim 13, further comprising a roller connected to said raising mechanism, said roller allowing movement of said first cord for drawing the curtain in the first direction.

20. The apparatus of claim 13, wherein said raising mechanism has a first bearing movably mounted in said guide member.

21. The apparatus of claim 20, wherein said first bearing has a first end with a head slidingly coupled to said guide member and a stem connected to a block having an annular element.

22. The apparatus of claim 21, further comprising a hook coupled to said annular element and attached to the curtain.

23. The apparatus of claim 21, further comprising a roller connected to a first arm of said block, said roller allowing movement of said first cord for drawing the curtain in the first direction.

24. The apparatus of claim 23, further comprising a shaft on which said roller slides, said shaft fitting into a ring at one end of said first arm of said block and being capable of interacting with the walls of a hole in said roller, said shaft being supported by a second bearing element attached to said guide member.

25. The apparatus of claim 24, further comprising a control mechanism connected to said shaft and said guide member, said control mechanism actuating movement of the curtain via interaction with a chain and said shaft.

26. An apparatus drawing a curtain vertically and horizontally, comprising:

a guide member;

a raising mechanism movably positioned in said guide member;

a first cord connected to the curtain and coupled to said raising mechanism, said first cord interacting with said raising mechanism for drawing the curtain vertically; and a second cord coupled to said raising mechanism and interacting with said raising mechanism for drawing the curtain horizontally.

27. The apparatus of claim 26, further comprising sliding elements movably positioned in said guide member and attached to the curtain.

28. The apparatus of claim 27, wherein said second cord is coupled to said sliding elements and said raising mechanism, and interacts with said sliding elements and said raising mechanism for drawing the curtain horizontally.

29. The apparatus of claim 26, wherein said guide member has a track on which said raising mechanism can slide.

30. The apparatus of claim 27, wherein said sliding elements have a first end with a head slidingly coupled to said guide member and a stem connected to an annular element.

31. The apparatus of claim 26, further comprising a draw slide mounted on said second cord, said draw slide interacting with said raising mechanism for drawing the curtain horizontally.

32. The apparatus of claim 26, further comprising a control mechanism affixed to said guide member and controlling movement of said first cord, said control mechanism causing said first cord to interact with said raising mechanism for drawing the curtain vertically.

33. The apparatus of claim 26, wherein said raising mechanism is ring-shaped.

34. The apparatus of claim 26, wherein said raising mechanism has a hook-like element designed to interact with a corresponding annular element affixed to the curtain.

35. The apparatus of claim 26, wherein said raising mechanism has a first end with a head slidingly coupled to said guide member.

* * * * *